US008246497B1

(12) United States Patent
Garcia

(10) Patent No.: US 8,246,497 B1
(45) Date of Patent: Aug. 21, 2012

(54) THROWING OBJECT

(76) Inventor: Adalberto Garcia, Providence, RI (US)

( * ) Notice: Subject to any disclaimer, the term of this patent is extended or adjusted under 35 U.S.C. 154(b) by 245 days.

(21) Appl. No.: 12/749,666

(22) Filed: Mar. 30, 2010

(51) Int. Cl.
*A63B 65/00* (2006.01)

(52) U.S. Cl. ..... 473/613; 473/589; 473/451; 446/48

(58) Field of Classification Search ..... 473/613, 473/387, 588, 589, 280, 281, 451, 422; D21/443, D21/444; 446/46, 48
See application file for complete search history.

(56) References Cited

U.S. PATENT DOCUMENTS

| | | | | | |
|---|---|---|---|---|---|
| 3,179,412 | A * | 4/1965 | Niederberger | 473/588 |
| 3,563,548 | A * | 2/1971 | Tolotti | 473/588 |
| 3,566,532 | A * | 3/1971 | Wilson | 446/46 |
| 4,152,863 | A * | 5/1979 | Kubiatowicz | 446/486 |
| 4,184,682 | A * | 1/1980 | Collins et al. | 473/596 |
| 4,320,593 | A * | 3/1982 | Sarkis | 446/47 |
| 4,354,326 | A * | 10/1982 | Mathews | 446/46 |
| 4,378,653 | A * | 4/1983 | O'Brien | 446/46 |
| 4,687,210 | A * | 8/1987 | Michel | 473/589 |
| 4,955,620 | A * | 9/1990 | Reinke | 473/613 |
| D352,896 | S * | 11/1994 | Jones | D9/503 |
| 5,472,187 | A * | 12/1995 | Kempf | 473/451 |
| 5,531,624 | A * | 7/1996 | Dunipace | 446/46 |
| 6,179,737 | B1 * | 1/2001 | Adler | 473/588 |
| 6,244,980 | B1 * | 6/2001 | Depcik | 473/613 |
| 6,599,162 | B2 * | 7/2003 | Huset | 446/46 |
| 6,918,809 | B2 * | 7/2005 | Persall | 446/46 |
| 2007/0207883 | A1 * | 9/2007 | Kenner | 473/588 |

* cited by examiner

*Primary Examiner* — Steven Wong
(74) *Attorney, Agent, or Firm* — Salter & Michaelson

(57) ABSTRACT

A throwing object that includes a multi-sided member that includes a top and a peripheral sidewall integral with the top. The top and peripheral sidewall together form a cap-shaped member that is hollow with the peripheral sidewall having an inner surface and an outer surface. The outer surface is formed as a concave surface shaped for receiving the finger or fingers of the user with the inner surface including a reinforcing rib that is integral with the sidewall.

20 Claims, 7 Drawing Sheets

THROWING OBJECT

FIELD OF THE INVENTION

The present invention relates in general to a throwing object. More particularly, the present invention relates to an object that is for hitting by a stick so as to simulate the hitting of a baseball by a baseball bat.

BACKGROUND OF THE INVENTION

One game that is played that uses a ball and bat has been termed "half ball." The bat is usually in the form of a stick such as a broomstick and the ball has typically been in the form of a half ball. The half ball may be provided by cutting a tennis ball in half or by cutting a small rubber ball in half. This half ball is thrown in a similar manner to the throwing of a baseball and the stick is used for batting the ball or disk.

FIGS. 1 and 2 show one prior art alternate version of a throwing object. FIG. 1 is a perspective view and FIG. 2 is a cross-sectional view taken along line 2-2 of FIG. 1. This ball, object or disk 10 is in the form of a cap-shaped member having a top wall 12 and an annular peripheral sidewall 14. On the outer surface of the sidewall 14, there is provided an annular ridge 16. The throwing object illustrated in FIGS. 1 and 2 is typically constructed of a plastic or relatively hard rubber material.

One of the problems associated with the object shown in FIGS. 1 and 2 is that the rib 16, which functions somewhat as a reinforcing rib, interferes with the holding of the throwing object. It is typical to grasp the outer surface of the annular part of the object with one or more fingers and the presence of the rib 16 makes this difficult.

Accordingly, it is an object of the present invention to provide an improved throwing object, particularly one that is for hitting by a stick in the playing of a game such as the conventional "half ball" game.

SUMMARY OF THE INVENTION

In accordance with the present invention there is provided a throwing disc for hitting by a stick so as to simulate the hitting of a baseball by a baseball bat but with a smaller diameter stick in comparison to the breadth of a baseball bat. The throwing disc comprises a multiple sided member that includes a top and a peripheral sidewall integral with the top. The top and peripheral sidewall together form a cap-shaped member that is hollow with the peripheral sidewall having an inner surface and an outer surface. The outer surface is formed as a concave surface shaped for receiving the fingers of the user with the inner surface including a reinforcing rib that is integral with the sidewall.

In accordance with other aspects of the present invention the peripheral sidewall further has a top edge integral with the top of the cap-shaped member, and a free peripheral edge; the reinforcing rib is preferably disposed about the peripheral sidewall at a location substantially midway between the free peripheral edge and the top edge of the peripheral sidewall; the reinforcing rib preferably has a semi-circular cross-section; the reinforcing rib may be annular and extends about the entire peripheral sidewall; the concave surface may be of a segment of a circle; the concave surface may be uniform and extends about the entire peripheral sidewall; the cap-shaped member is preferably constructed of a plastic material; and the reinforcing rib may be annular and extends about the entire peripheral sidewall.

In accordance with another version of the invention there is provided a throwing disc for hitting by a stick so as to simulate the hitting of a baseball by a baseball bat but with a smaller diameter stick in comparison to the breadth of a baseball bat, the throwing disc comprising: a cap-shaped member that includes a top and a peripheral sidewall integral with the top; the cap-shaped member being constructed of a plastic material and being hollow with an open bottom; the peripheral sidewall having an inner annular surface and an outer annular surface; the outer annular surface formed as a concave surface shaped for receiving the fingers of the user; the concave surface of a circular cross-section; the inner surface including a reinforcing rib that is integral with the sidewall.

Other aspects of the invention include the peripheral sidewall further has a top edge integral with the top of the cap-shaped member, and a free peripheral edge; the reinforcing rib is disposed about the peripheral sidewall at a location substantially midway between the free peripheral edge and the top edge of the peripheral sidewall; the reinforcing rib preferably has a semi-circular cross-section; the reinforcing rib may be annular and extends about the entire peripheral sidewall; and the concave surface is preferably uniform and extends about the entire peripheral sidewall.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 8:
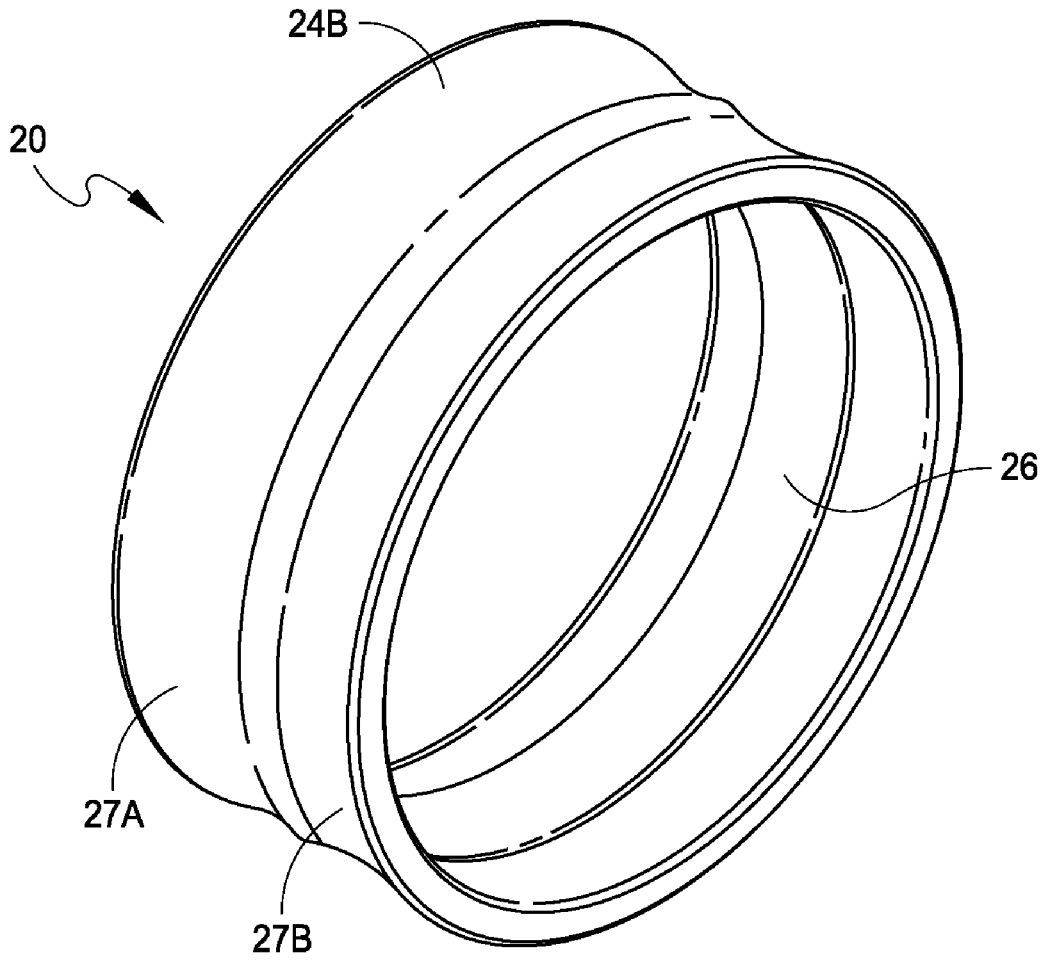
FIG. 8 is a perspective view of an alternate embodiment of the throwing object of the present invention.
Figure 9:
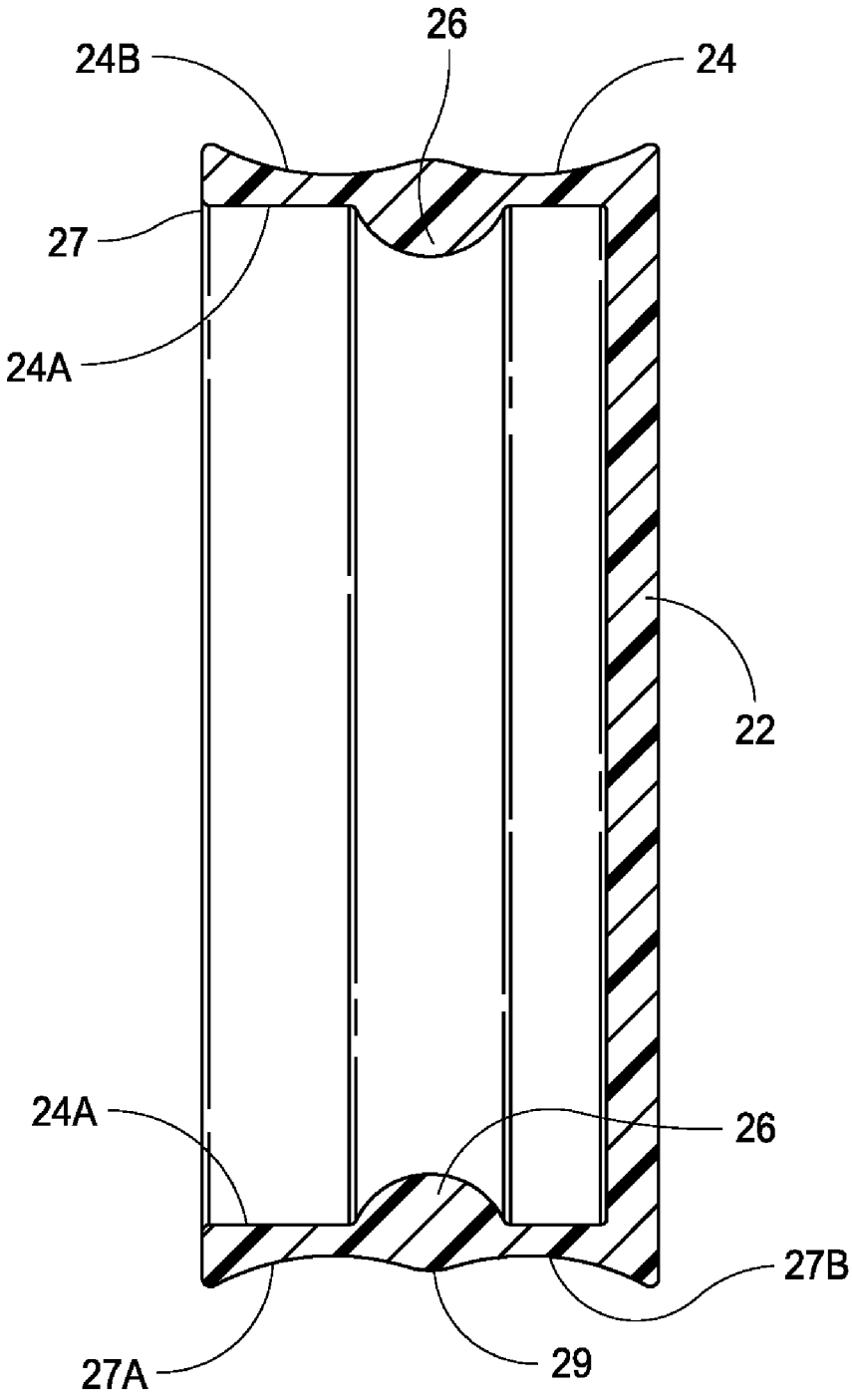
FIG. 9 is a cross-sectional view of this alternate embodiment.

The present invention describes an improved throwing object that is meant primarily for hitting by a stick such as a cut off broomstick. In this regard refer to the partial diagram of FIG. 10 herein. The purpose of this game, sometimes called "half ball," is to simulate the hitting of a baseball by a baseball bat but with the use of a smaller diameter stick in comparison to the breadth of a baseball bat. In this regard reference is made now to FIGS. 3-7 for an illustration of a first embodiment of the present invention. A second embodiment of the present invention is illustrated in FIGS. 8 and 9.

Figure 7:
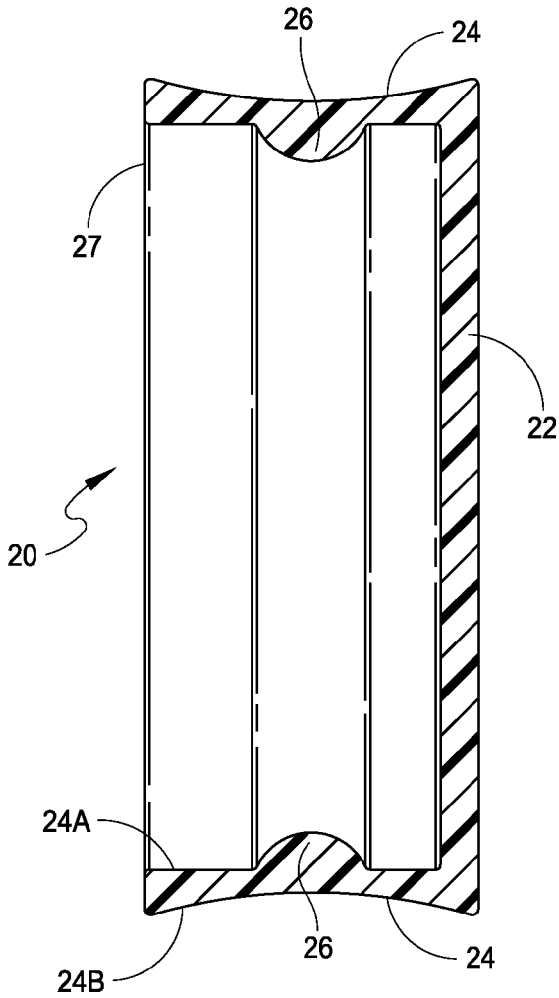
FIG. 7 is a cross-sectional view taken along line 7-7 of FIG. 6.

Now, with reference to FIGS. 3-7, the throwing object 20 of the present invention is comprised of a cap-shaped member that includes a top wall 22 and a peripheral annular sidewall 24 that is integral with the top wall. The cross-sectional view of FIG. 7 illustrates the one piece nature of this cap member. Of course, in an alternate embodiment the top and sidewalls could be constructed separately and joined in an appropriate manner. This cap-shaped member is constructed of preferably a plastic material or a rubber material that is not too soft so that it retains its shape even after being contacted a number of times by the stick-like bat. The top 22 is preferably of a uniform thickness as depicted in FIG. 7. The sidewall 24 has an inner annular surface 24A and an outer annular surface 24B as depicted in FIG. 7. Surfaces 24A and 24B preferably extend about the entire periphery of the object. As also noted in FIG. 7, the outer annular surface 24B is formed as a concave surface shaped for receiving the finger or fingers of the user. The concave surface 24B is preferably circular having a radius of curvature that is at least equal to the diameter of the cap member. The surface 24B also preferably extends about the entire periphery of the object. As shown, the outer surface of the peripheral sidewall has a top annular edge integral with the top of the cap-shaped member and a free annular edge, the concave surface being formed between the respective top and free annular edges and extending about the entire peripheral sidewall, both of the respective top and free annular edges are disposed substantially the same distance from the longitudinal axis of the cap-shaped member.

Figure 1:
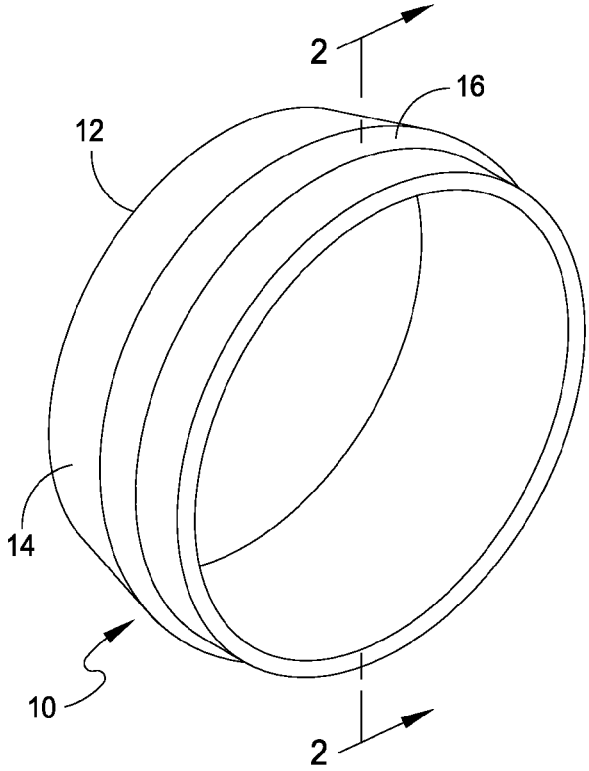
FIG. 1 (PRIOR ART)
FIG. 1 is a perspective view of a prior art throwing object.
Figure 2:
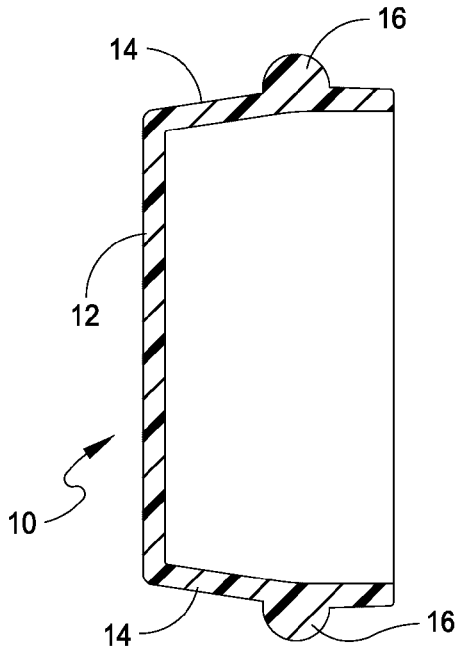
FIG. 2 (PRIOR ART)
FIG. 2 is a cross-sectional view taken along line 2-2 of FIG. 1 of the same prior art throwing object.
Figure 3:
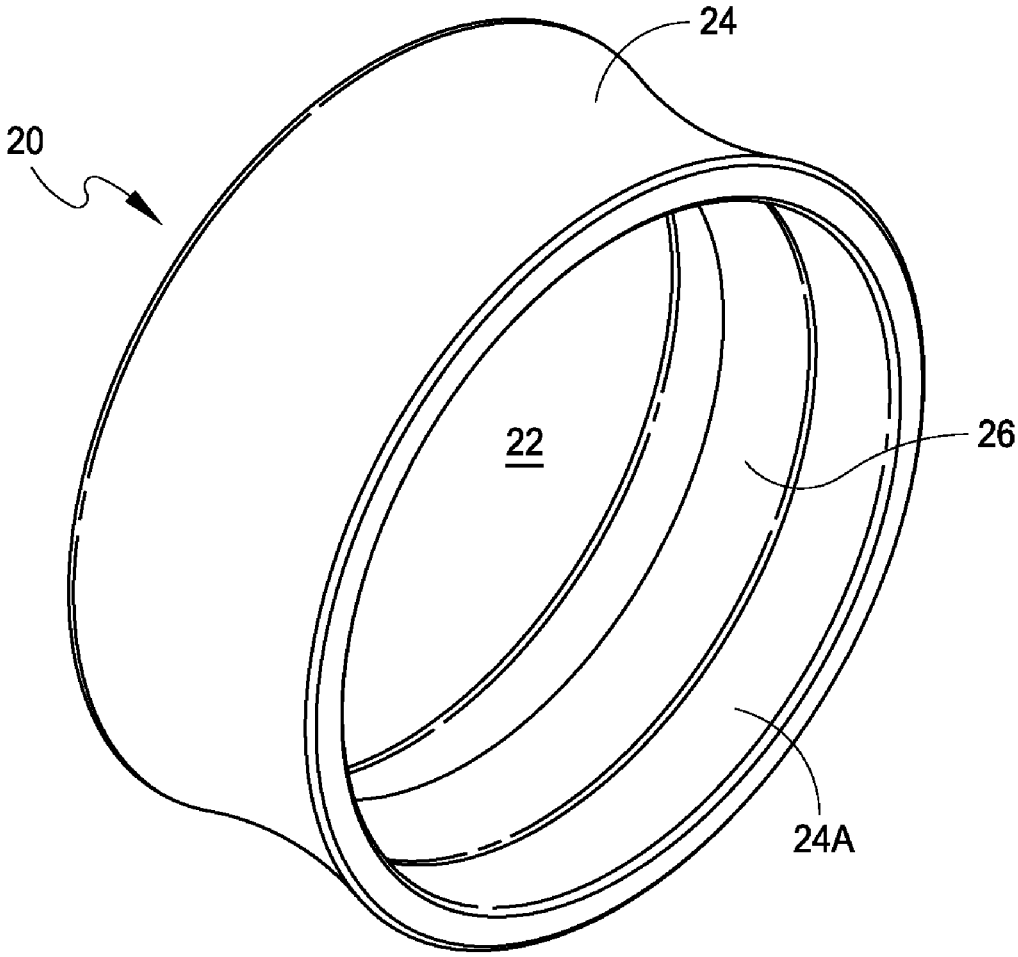
FIG. 3 is a perspective view of a preferred embodiment of the throwing object of the present invention.
Figure 4:
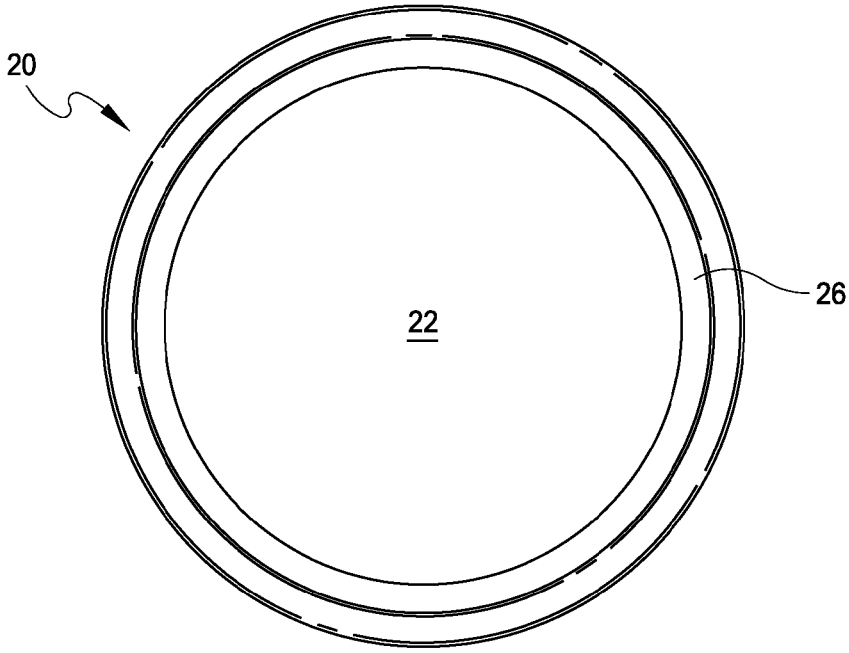
FIG. 4 is a bottom plan view of the throwing object of FIG. 3.
Figure 5:
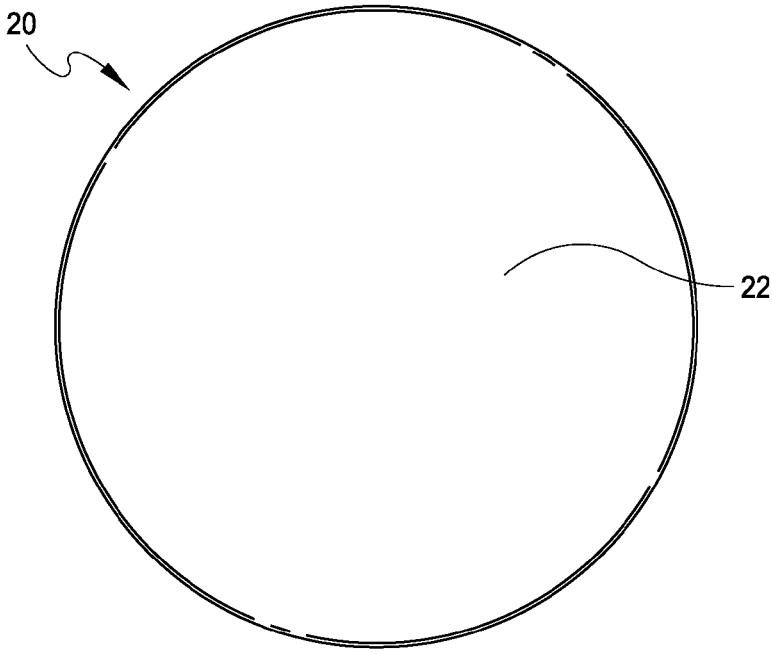
FIG. 5 is a top plan view of the throwing object of FIG. 3.
Figure 6:
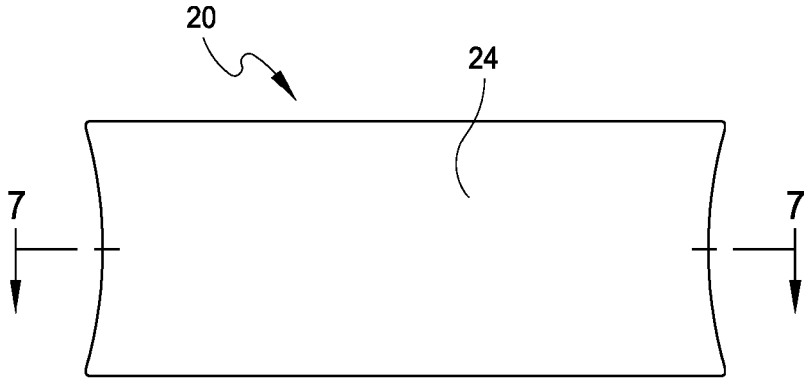
FIG. 6 is a side elevation view of the object of FIG. 3.

Preferably, the mean diameter of the cap member at the opening thereof is on the order of 2 inches and the thickness from the opening to the wall 22 is on the order of 1 inch. With regard to the inner surface 24A, it is again illustrated in FIGS. 3, 4 and 7, and there is provided a reinforcing rib 26 integral with the annular wall 24. The rib 26 is also annular in shape and extends about the entire periphery of the throwing object, as depicted in FIG. 4. The rib 26 is preferably approximately centered between the opening into the cap member at 27 and the wall 22. As illustrated in FIG. 7, this cap member is substantially hollow on the inside.

With the arrangement illustrated in FIGS. 3-7, it is noted that there is no protrusion or projection on the outer surface 24B and thus there is a smooth surface for easy grasping by the finger or fingers of the user. The reinforcement is found on the inner surface by the annular rim 26. In this way the reinforcing rib does not interfere with the throwing of the object. The reinforcing rib 26, as noted in FIG. 7, also preferably has a circular cross-sectional shape. The outer surface 24B is uniform about the entire outer surface preferably without any projections or bumps.

Reference is now made to an alternate embodiment illustrated in FIGS. 8 and 9. In FIGS. 8 and 9 the same reference characters are used as previously described in connection with the first embodiment. The primary difference between this alternate embodiment and FIGS. 8 and 9 and the embodiment in FIGS. 3-7 is that the outer surface 24B is now provided in two separate annular grooves 27A and B with a peak 29 therebetween. This is useful when it is desired to use two fingers for throwing the object. Each finger can then be placed in the respective grooves 27A and 27B.

Figure 10:
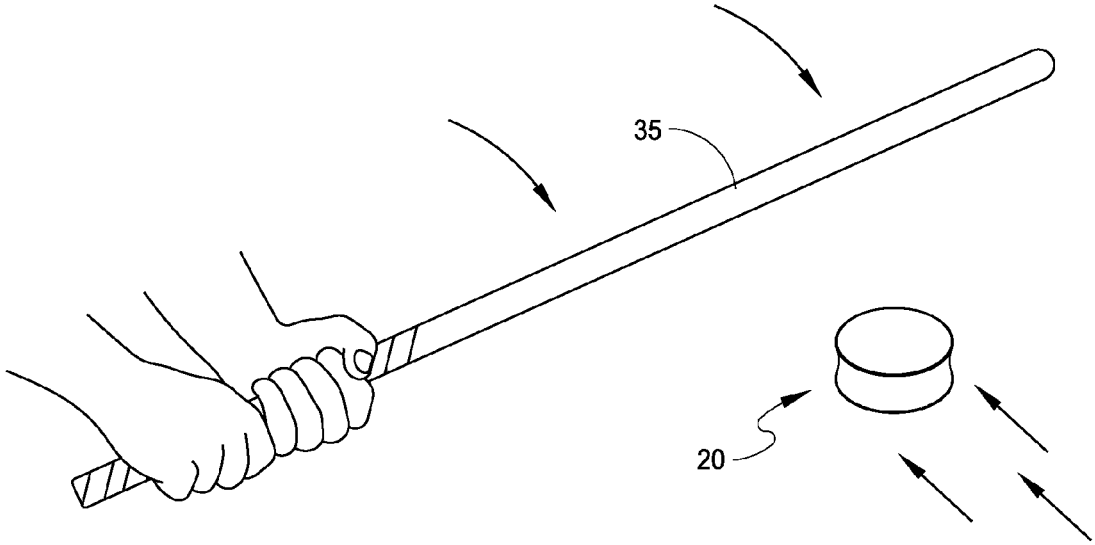
FIG. 10 is a schematic illustration of the use of a stick in hitting the throwing object.

In FIG. 10 there is schematically illustrated the throwing object 20 as may appear when it is thrown towards the bat or in the case illustrated in FIG. 10, the batting stick 35. The object of the game played with the throwing object of the present invention is the same as presently used in "half ball" games.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A throwing disc for hitting by a stick so as to simulate the hitting of a baseball by a baseball bat but with a smaller diameter stick in comparison to the breadth of a baseball bat, the throwing disc comprising, a multiple sided member that includes a top and a peripheral sidewall integral with the top, the top and peripheral sidewall together forming a cap-shaped member that is hollow with an open bottom and has a longitudinal axis extending through the top, the peripheral sidewall having an inner surface and an outer surface, the outer surface formed as a concave surface shaped for receiving the fingers of the user, the inner surface including a reinforcing rib that is integral with the sidewall, the outer surface of the peripheral sidewall further having a top annular edge integral with the top of the cap-shaped member and a free annular edge, the concave surface being formed between the respective top and free annular edges and extending about the entire peripheral sidewall, both of the respective top and free annular edges being disposed substantially the same distance from the longitudinal axis.

2. The throwing disc of claim 1 wherein the reinforcing rib has a semi-circular cross-section of a radius less than the radius of the concave surface.

3. The throwing disc of claim 2 wherein the reinforcing rib is disposed about the peripheral sidewall at a location substantially midway between the free peripheral edge and the top edge of the peripheral sidewall.

4. The throwing disc of claim 1 wherein the reinforcing rib has a semi-circular cross-section.

5. The throwing disc of claim 4 wherein the reinforcing rib is annular and extends about the entire peripheral sidewall.

6. The throwing disc of claim 1 wherein the inner surface of the peripheral sidewall, on either side of the reinforcing rib, is flat in cross-section.

7. The throwing disc of claim 6 wherein the inner surface of the peripheral sidewall, on either side of the reinforcing rib, is annular extending about the entire peripheral sidewall.

8. The throwing disc of claim 1 wherein the concave surface has a pair of adjacent concave grooves.

9. The throwing disc of claim 8 wherein the adjacent grooves each have a concave surface and are joined at a single peak.

10. The throwing disc of claim 9 wherein each of the grooves has the same radius of curvature.

11. The throwing disc of claim 1 wherein the concave surface is of a segment of a circle.

12. The throwing disc of claim 11 wherein the concave surface is uniform and extends about the entire peripheral sidewall.

13. The throwing disc of claim 1 wherein the concave surface is uniform and extends about the entire peripheral sidewall.

14. A throwing disc for hitting by a stick so as to simulate the hitting of a baseball by a baseball bat but with a smaller diameter stick in comparison to the breadth of a baseball bat, the throwing disc comprising:

a cap-shaped member that includes a top and a peripheral sidewall integral with the top;

the cap-shaped member being constructed of a plastic material and being hollow with an open bottom and has a longitudinal axis extending through the top;

the peripheral sidewall having an inner annular surface and an outer annular surface;

the outer annular surface formed as a concave surface shaped for receiving the fingers of the user;

the concave surface being circular in shape;

the inner surface including a reinforcing rib that is integral with the sidewall;

the outer annular surface of the peripheral sidewall further having a top annular edge integral with the top of the cap-shaped member and a free annular edge, the concave surface being formed as a pair of adjacent concave grooves disposed between the respective top and free annular edges and extending about the entire peripheral sidewall, both of the respective top and free annular edges being disposed substantially the same distance from the longitudinal axis.

15. The throwing disc of claim 14 wherein the reinforcing rib has a semi-circular cross-section of a radius less than the radius of the concave surface.

16. The throwing disc of claim 15 wherein the reinforcing rib is disposed about the peripheral sidewall at a location substantially midway between the free peripheral edge and the top edge of the peripheral sidewall.

17. The throwing disc of claim 14 wherein the adjacent grooves are joined at a single peak.

18. The throwing disc of claim 17 wherein each of the grooves has the same radius of curvature.

19. The throwing disc of claim 17 wherein the peak extends substantially the same distance from the longitudinal axis as the respective top and free annular edges.

20. The throwing disc of claim 19 wherein each of the grooves has the same radius of curvature, the inner surface of the peripheral sidewall, on either side of the reinforcing rib, is flat in cross-section, and the inner surface of the peripheral sidewall, on either side of the reinforcing rib, is annular extending about the entire peripheral sidewall.

* * * * *